US005095410A

United States Patent [19]

Nagengast et al.

[11] Patent Number: 5,095,410

[45] Date of Patent: Mar. 10, 1992

[54] RETAINER ARRANGEMENT FOR A REPLACEABLE LAMP BULB ASSEMBLY

[75] Inventors: William E. Nagengast; David R. McMahan, both of Anderson; Philip C. Filosa, Indianapolis; Harry L. Kirchenbauer, Anderson, all of Ind.

[73] Assignee: General Motors Corporation, Detroit, Mich.

[21] Appl. No.: 740,780

[22] Filed: Aug. 6, 1991

[51] Int. Cl.[5] ..... F21V 29/00; F21M 3/00

[52] U.S. Cl. ..... 362/61; 362/294

[58] Field of Search ..... 362/61, 80, 267, 226, 362/294, 373

[56] References Cited

U.S. PATENT DOCUMENTS

| | | | |
|---|---|---|---|
| 3,593,017 | 7/1971 | Cibie | 362/294 |
| 4,731,709 | 3/1988 | Freudenreich et al. | 362/294 |
| 4,862,337 | 8/1989 | Ohshio et al. | 362/294 |
| 4,931,912 | 6/1990 | Kawakami et al. | 362/294 |
| 5,010,453 | 4/1991 | Ketterman | 362/294 |

*Primary Examiner*—Ira S. Lazarus
*Assistant Examiner*—Richard R. Cole
*Attorney, Agent, or Firm*—Edward J. Biskup

[57] ABSTRACT

A retainer arrangement for a replaceable lamp bulb assembly that cooperates with a vent formed in the reflector body of a headlamp for establishing a labyrinth type flow path for air to enter and exit the interior of the headlamp.

3 Claims, 1 Drawing Sheet

RETAINER ARRANGEMENT FOR A REPLACEABLE LAMP BULB ASSEMBLY

Figure 1:
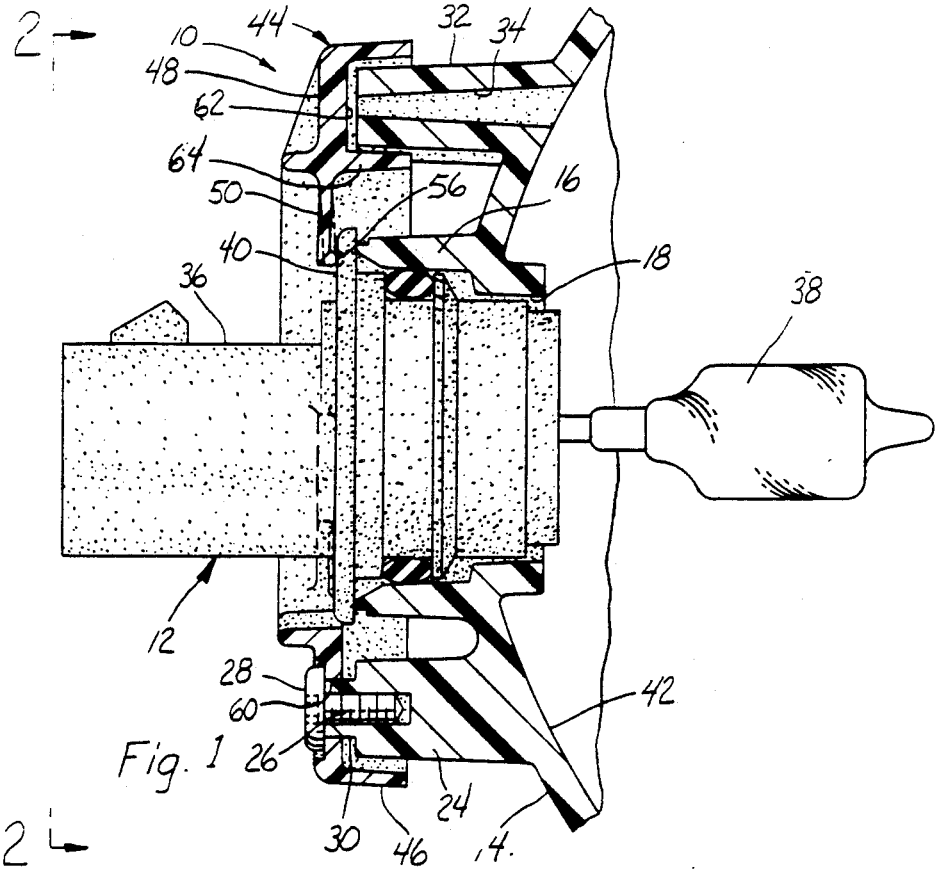

This invention concerns headlamps, in general, and more particularly pertains to a retainer arrangement for maintaining a replaceable lamp bulb assembly within a socket located in the rear of a vehicle headlamp.

More specifically, the retainer arrangement according to the present invention is adapted to cooperate with a pipe-like portion on the headlamp reflector adjacent the socket to establish a labyrinth-type flow path for air to enter and exit the interior of the headlamp. The bulb assembly within the socket has an annular flange and the socket is defined by a cylindrical boss having an opening for receiving the bulb assembly with the flange located in a predetermined angular position in engagement with the end of the boss. In the preferred form, the retainer arrangement includes three circumferentially and equally spaced enlarged heads projecting axially outwardly from the rear of the headlamp reflector and surrounding the cylindrical boss. Each of the heads has the center thereof located on a common circle having its center coincidental with the center of the socket. An annular retainer nut is provided which has an axially extending rim formed integrally with an end wall extending radially inwardly from the rim. Three key-hole shaped slots and these contact means are integrally formed with the end wall and each contact means has a contact edge. The enlarged heads are adapted to receive the keyhole slots of the retainer nut with the contact edge of each contact means engaging the flange of the bulb assembly after which the retainer nut is rotated to a locked position so that the rim of the retainer nut covers the pipe-like portion of the reflector with the air passage therein being located adjacent to and spaced from the end wall of the retainer nut.

The objects of the present invention are to provide a new and improved retainer arrangement for a replaceable lamp bulb assembly that cooperates with a vent formed in the reflector body of a headlamp for establishing a labyrinth-type flow path for air to enter and exit the interior of the headlamp; to provide a new and improved retainer arrangement having a retainer nut that is secured to the socket portion of a headlamp for maintaining a replaceable lamp bulb assembly within the socket and for providing a labyrinth flow path for air that permits the headlamp interior to be vented; to provide a new and improved retainer arrangement for maintaining a replaceable lamp bulb assembly within a socket formed in a headlamp reflector and which includes a pipe-like vent that coacts with a retainer nut for providing an air flow path for venting the interior of the headlamp; and to provide a new and improved retainer arrangement for a replaceable lamp bulb assembly that includes a retainer nut attachable to the reflector body through three circumferentially spaced enlarged head members located around the socket formed in the reflector member and in which the retainer nut has an integral portion that serves to cover a vent leading to the interior of the headlamp and thereby create a labyrinth flow path for air to enter and exit the interior of the headlamp.

The following patents disclose lamp bulb fastening arrangements which have some similarity to the present invention but differ structurally and functionally therefrom:

French U.S. Pat. No. 2,033,699 issued on Mar.10, 1936

Doane et al U.S. Pat. No. 2,110,130 issued on Mar. 8, 1938

Falge et al U.S. Pat. No. 2,219,770 issued on Oct. 29, 1940

Douglas U.S. Pat. No. 2,117,759, issued on May 17, 1938

Mikola U.S. Pat. No. 4,513,356 issued on Apr. 23, 1985

Van Duyn et al U.S. Pat. No. 4,679,128 issued on July 7, 1987

Figure 2:
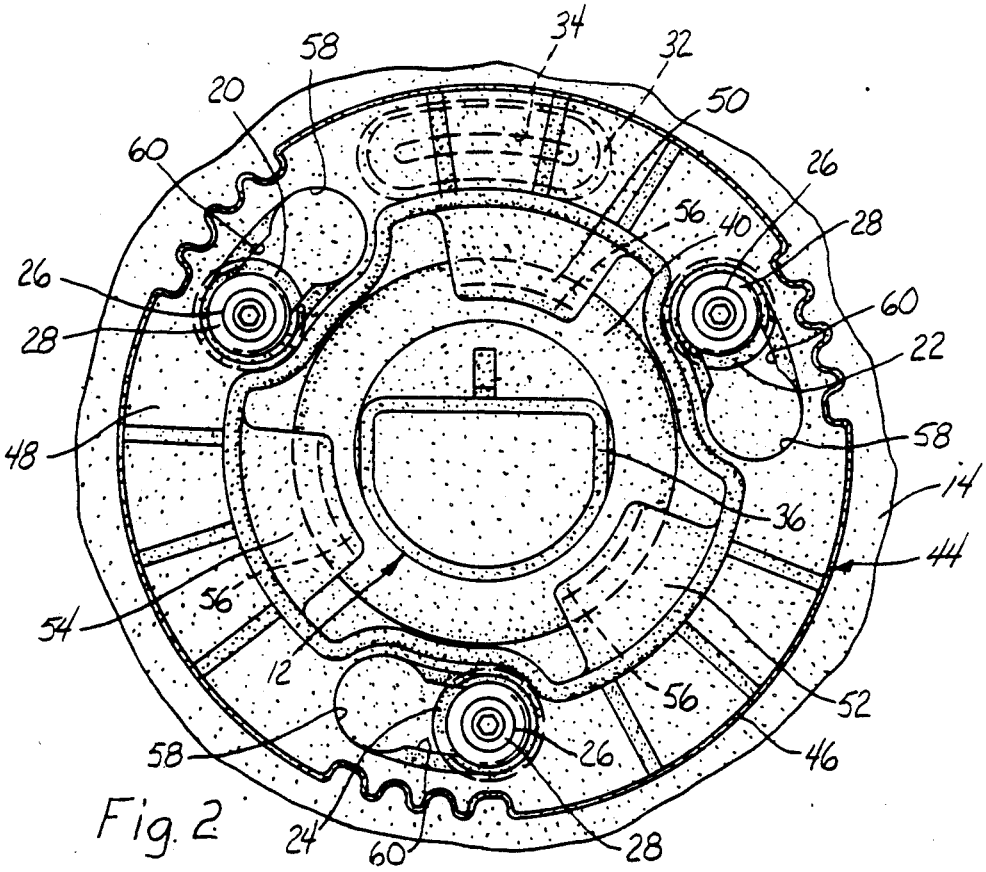

Other objects and advantages of the present invention will be apparent from the following detailed description when taken with the drawing in which:

FIG. 1 is a sectional view of a retainer arrangement made in accordance with the present invention for maintaining a replaceable lamp bulb assembly within a socket formed in the rear of a vehicle headlamp; and FIG. 2 is an end view of the retainer arrangement taken on line 2—2 of FIG. 1.

Referring to the drawing, a retainer arrangement is shown for maintaining a replaceable headlamp bulb assembly within a socket formed in the rear of a headlamp having a reflector 14 which is made of a plastic material. The socket is defined by a cylindrical boss 16 which is integrally formed with the body of the reflector 14 and has a circular opening 18 for receiving the bulb assembly 12. Three identical circumferentially equally spaced and axially extending projections 20, 22, and 24 surround the cylindrical boss 16 and each projection 20–24 threadably receives a screw 26 provided with an enlarged head 28. In each instance, the enlarged head 28 is in contact with a reduced round portion 30 integrally formed at the end of each of the associated projection 20–24. Also, the center of each head 28 is located on a common circle having its center coincidental with the center of the opening 18. In addition, a pipe-like portion 32 is integrally formed with the rear of the reflector 14 between the projections 20 and 22 as seen in FIG. 2. The pipe-like portion 32 has a through-passage 34 which connects the interior of the headlamp with atmosphere for purposes which will be more fully explained hereinafter.

The bulb assembly 12 is of the conventional replaceable type having a molded plug body 36 which retains the base of a lamp 38. As seen in FIG. 1, the plug body 36 of bulb assembly is formed with an annular flange 40 and has three circumferentially spaced grooves (not shown) which are sized and angularly spaced so as to be complementary to three ribs (not shown) integrally formed within the opening 18 of the cylindrical boss 16 to thereby allow predetermined angular positioning of the bulb assembly 12 relative to the boss 16. It will be noted that when the bulb assembly 12 is located in the opening 18 of the socket, the flange 40 is in contact with the end of the boss 16 to position the lamp axially relative to the parabolic reflecting surface 42 of the reflector. Also, the bulb assembly 12 is retained in this position within the socket by a hand-operated lock or retainer nut 44.

In this regard, the retainer nut 44 is adapted to cooperate with the three enlarged heads 28 of the screws 26 for maintaining the bulb assembly 12 within the socket of the reflector. As seen in FIGS. 1 and 2, the retainer nut 44 is a molded plastic part that is cup-shaped as seen in cross section in FIG. 1, and includes an axially extending annular rim 46 integrally formed at its rear end with an end wall 48 which extends radially inwardly therefrom. The end wall 48 is integrally formed with three identical press or contact sections 50, 52 and 54 each of which has an annular contact edge 56. In addition, the end wall 48 is formed with three circumferentially equally spaced key-hole openings each of which has the usual enlarged circular portion 58 which in this case is larger in diameter than the diameter of the enlarged head 28 formed with each screw 26. The usual elongated portion 60 of the key-hole opening is sized so as to snugly receive the round portion 30 at the end of each projection 20–24.

Thus, from the above description, it should be apparent that after the bulb assembly 12 is located in the socket as seen in FIG. 1, the retainer nut 44 has the circular portion 58 of each key-hole opening axially aligned with one of the enlarged heads 28 of the screws 26 on the three projections 20–24. The retainer nut 44 is then moved towards the enlarged heads 28 so that they extend through the aligned circular portions 58 of the key-hole openings, after which the retainer nut 44 is rotated clock-wise until the end of the elongated portion 60 is contacted. This causes the retainer nut 44 to be locked in the position seen in FIG. 2 with the contact edge 56 of the three contact sections 50-54 pressing the flange 40 into engagement with the end of the boss 16. As seen in FIG. 1, with the retainer nut 44 locked on the reflector 14, the bulb assembly 12 is retained within the socket and the inner surface 62 of the end wall 48 is spaced from the end of the pipe-like portion 32 a distance as seen in FIG. 1. A lower axially extending wall 64 which is perpendicular to the end wall 48 and integral therewith is then positioned below the pipe-like portion 32 so as to establish a labyrinth-type flow path for air to enter and exit the interior of the headlamp via the passage 34 in the pipe-like portion 32.

Various changes and modifications can be made in the above-described construction without departing from the spirit of the invention. Accordingly, the inventors do not wish to be limited except by the scope of the appended claims.

The embodiments of the invention in which an exclusive property or privilege is claimed are defined as follows:

1. A retainer arrangement for maintaining a replaceable bulb assembly within a socket located at the rear of a headlamp and adapted to establish a labyrinth-type flow path for air to enter and exit the interior of the headlamp, the bulb assembly having an annular flange, a pipe-like portion secured to the rear of the reflector and having an air passage, the socket being located adjacent the pipe-like portion and being defined by a cylindrical boss having an opening for receiving the bulb assembly with the flange located in a predetermined angular positon in engagement with the terminal end of the boss, the retainer arrangement including lock means formed on the rear of the headlamp and surrounding the cylindrical boss, an annular retainer nut provided with an axially extending rim, an end wall integral with the rim and extending radially inwardly therefrom, and contact means integrally formed with the end wall and having a contact edge, the retainer nut adapted to engage the lock means with the contact edge of the contact means engaging the flange of the bulb assembly after which the retainer nut is rotated to a locked position so that the rim of the retainer nut covers the pipe-like portion with end of the air passage being located adjacent to and spaced from the end wall of the retainer nut so as to establish the labyrinth-type flow path for the air entering and exiting the interior of the headlamp.

2. A retainer arrangement for maintaining a replaceable bulb assembly within a socket located at the rear of a reflector member of a headlamp and adapted to cooperate with a pipe-like portion secured to the reflector member to establish a labyrinth-type flow path for air to enter and exit from the interior of the headlamp, the bulb assembly having an annular flange and the socket being located adjacent the pipe-like portion and being defined by a boss having a circular opening for receiving the bulb assembly with the flange located in a predetermined angular position in engagement with the end of the boss, the retainer arrangement including at least two enlarged heads projecting axially outwardly from the rear of the headlamp reflector and surrounding the boss, an annular retainer nut provided with an axially extending rim, an end wall integral with the rim and extending radially inwardly therefrom, the end wall having key-hole shaped slots formed therein, and contact means integrally formed with the end wall and having a contact edge, the enlarged heads adapted to receive the keyhold slots of the retainer nut with the contact edge of the contact means engaging the flange of the bulb assembly after which the retainer nut is rotated to a locked position so that the rim of the retainer nut covers the pipe-like portion with the end of the pipe-like portion being adjacent to and spaced from the end wall of the retainer nut so as to provide the labyrinth-type flow path for the air entering and exiting the interior of the headlamp.

3. A retainer arrangement for maintaining a replaceable bulb assembly within a socket located at the rear of a reflector member of a headlamp and adapted to cooperate with a pipe-like portion secured to the reflector member to establish a labyrinth-type flow path for air to enter and exit the interior of the headlamp, the bulb assembly having an annular flange and the socket being located adjacent the pipe like portion and being defined by a cylindrical boss having an opening for receiving the bulb assembly with the flange located in an predetermined angular position in engagement with the terminal end of the boss, the retainer arrangment including three circumferentially and equally spaced enlarged heads projecting axially outwardly from the rear of the headlamp reflector and surrounding the cylindrical boss, each of the heads having the center thereof located on a common circle having its center coincidental with the center of the circular opening of the socket, an annular retainer nut provided with an axially extending rim, and end wall integral with the rim and extending radially inwardly therefrom, three key-hole shaped slots formed in the end wall, and contact means integrally formed with the end wall and having a contact edge, the enlarged heads adapted to receive the keyhold slots of the retainer nut with the contact edge of the contact means engaging the flange of the bulb assembly after which the retainer nut is rotated to a locked position so that the rim of the retainer nut covers the pipe like portion with the end of the pipe-like portion being adjacent to and spaced from the end wall of the retainer nut a distance so as to provide the labyrinth-type flow path for the air entering and exiting the interior of the headlamp.

* * * * *